US008393660B2

(12) United States Patent
Luyendijk et al.

(10) Patent No.: US 8,393,660 B2
(45) Date of Patent: Mar. 12, 2013

(54) GRIPPING MEMBER FOR A WORK TOOL

(75) Inventors: Dirk Jacobus Luyendijk, Heesch (NL); Patrick Hartog Grant, Tilburg (NL); Dirk Jan Weijers, Zaltbommel (NL)

(73) Assignee: Caterpillar Work Tools B.V., S'Hertogenbosch (NL)

( * ) Notice: Subject to any disclaimer, the term of this patent is extended or adjusted under 35 U.S.C. 154(b) by 128 days.

(21) Appl. No.: 12/775,540

(22) Filed: May 7, 2010

(65) Prior Publication Data

US 2010/0301622 A1 Dec. 2, 2010

Related U.S. Application Data

(60) Provisional application No. 61/182,393, filed on May 29, 2009.

(51) Int. Cl.
*B66C 1/42* (2006.01)

(52) U.S. Cl. ..... 294/86.4; 37/446

(58) Field of Classification Search ..... 294/86.4, 294/198, 106, 56, 902; 81/421, 422, 423; 37/446, 468, 406, 449, 407, 454, 266; 172/701.1–701.3
See application file for complete search history.

(56) References Cited

U.S. PATENT DOCUMENTS

| | | | | | |
|---|---|---|---|---|---|
| 2,981,015 | A | * | 4/1961 | Duke | 37/449 |
| 3,029,534 | A | * | 4/1962 | Rakisits | 172/701.2 |
| 3,152,411 | A | * | 10/1964 | Wood | 172/701.3 |
| 3,685,177 | A | * | 8/1972 | Hahn et al. | 37/446 |
| 3,767,070 | A | | 10/1973 | Arnold | |
| 4,058,173 | A | * | 11/1977 | Carson | 172/701.3 |
| 4,457,380 | A | * | 7/1984 | Curry | 172/701.3 |
| 5,042,219 | A | | 8/1991 | Fricker | |
| 5,056,845 | A | | 10/1991 | Cook | |
| 5,746,017 | A | * | 5/1998 | Marvik | 37/446 |
| 5,890,667 | A | | 4/1999 | Sakato et al. | |
| 6,405,460 | B1 | | 6/2002 | Whitmire et al. | |
| 2006/0048851 | A1 | | 3/2006 | Wager | |

FOREIGN PATENT DOCUMENTS

| | | | |
|---|---|---|---|
| DE | 29 36 950 | A | 3/1980 |
| DE | G 91 12 470.0 | | 2/1992 |
| EP | 1679462 | A2 | 7/2006 |
| GB | 594050 | | 10/1947 |
| JP | 51-154880 | U | 12/1976 |
| JP | 4-054558 | U | 5/1992 |

OTHER PUBLICATIONS

Dahaco, Hydraulic Demolition-Sorting Grabs, DSG Series, 6 pages, printed from internet website, date and place of publication assumed to be 2006, Holland.

* cited by examiner

*Primary Examiner* — Dean Kramer
*Assistant Examiner* — Stephen Vu
(74) *Attorney, Agent, or Firm* — Liell & McNeil

(57) ABSTRACT

A gripping member for a work tool is provided such that in one embodiment, the gripping (or cutting) member includes a top and bottom surface, and a first gripping edge extending between the top and bottom surfaces, and a overbite block located proximate to the first gripping edge.

18 Claims, 3 Drawing Sheets

GRIPPING MEMBER FOR A WORK TOOL

RELATION TO OTHER PATENT APPLICATION

This application claims priority to U.S. Provisional Patent Application Ser. No. 61/182,393 filed May 29, 2009.

TECHNICAL FIELD

This disclosure relates generally to an apparatus for gripping or cutting material with a work tool, and more particularly, to a gripping edge for a work tool.

BACKGROUND

A grapple is generally a well known type of work tool that is often attached to machinery, such as excavators, backhoes etc. Applications of a grapple include material gripping, handling, or cutting capability. Used with an excavator, this gripping and handling capability makes the excavator suitable for a variety of operations. For example, excavators employing grapple assemblies are often used in demolition (e.g, tearing down lightweight structures made of wood or brick, or sorting, picking, placing, and loading materials, or cutting materials if needed).

Typically grapples include two gripping members (sometimes referred to as blades or cutting edges) that are attachable to the grapple, and when brought together, grip the desired material. That is, the grapple has a shell, and these gripping members are each associated with one portion of the shell, such that as the shell is closed, the gripping members grip the material.

For new gripping members, if no material was involved and the shells were closed, the gripping members would contact each other on a gripping edge of the gripping member. As the gripping members wear, and more particularly, as the gripping edge of these members wear, an overbite forms between the members when they are brought together. For example, one gripping edge will go over the other gripping edge, instead of having the edges come together. This overbite can cause inefficiencies in gripping and cutting material.

There are some grapple implementations that use mechanical end stops to control the distance a grapple shell travels. When the gripping members are new, the mechanical end stops aid in stopping the travel of the shell when the gripping edges come together. However, as the gripping edges wear, the mechanical stops, stop the shells at approximately the same range of travel, resulting in a gap between the gripping edges. Again, this gap can cause inefficiencies in gripping and cutting material. Even if the mechanical end stops allowed the grapple shells to travel further to account for the gap, the result would still be an overbite between the two gripping surfaces as shown in FIG. 6.

The present invention is directed to overcome or improve one or more disadvantages associated with the prior methods and apparatus.

SUMMARY OF THE DISCLOSURE

In one aspect of the present disclosure, a gripping member attachable to a work tool is disclosed. The gripping member includes a top surface and a bottom surface, and a first gripping edge extending between the top and bottom surfaces. In addition, the gripping member has an overbite block located proximate to the first gripping edge.

In another aspect of the present disclosure, a work tool having a first and second attachable gripping members is disclosed. The gripping members have a gripping edge having a length, and an overbite block located proximate to the gripping edge.

In still another aspect, an overbite block is for attachment to a grapple to prevent an overbite configuration of a first gripping member with respect to a second gripping member. The overbite block includes a uniform block of material having a single fastener bore therethrough that is located remote from a wear surface. The overbite block has a shape and size to be received in a cavity defined by one of a gripping member and a base bar of a grapple. The overbite block includes a gripping member contact surface and a grapple base bar contact surface.

BRIEF DESCRIPTION OF THE DRAWINGS

The accompanying drawings, which are incorporated in and constitute a part of this specification, illustrate exemplary embodiments and, together with the description, serve to explain principles of the disclosure. In the drawings.

FIG. 8 shows a perspective view of one gripping member with grapple according to the present disclosure;

Figure 1:
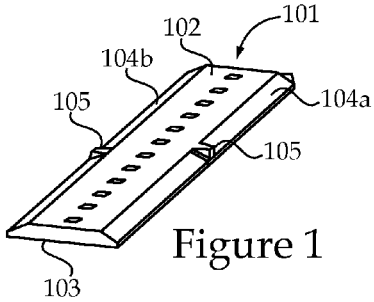
FIG. 1 is a perspective view of a gripping member as hereinafter described.
Figure 2:
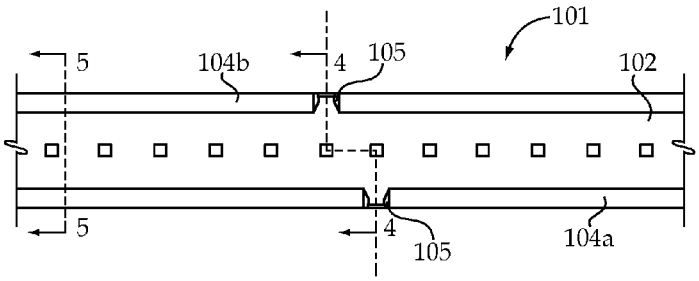
FIG. 2 is a top view of a gripping member as hereinafter described.

Although the drawings depict exemplary embodiments or features of the present invention, the drawings are not necessarily to scale, and certain features may be exaggerated in order to better illustrate and explain the present invention. The exemplifications set out herein illustrate exemplary embodiments or features of the invention and such exemplifications are not to be construed as limiting the scope of the invention in any manner.

DETAILED DESCRIPTION

Reference will now be made in detail to embodiments or features of the invention, examples of which are illustrated in the accompanying drawings. Generally, the same or corresponding reference numbers will be used throughout the drawings to refer to the same or corresponding parts.

FIGS. 1-5 illustrate a gripping member (101) having a top surface 102, a bottom surface 103, a first gripping edge 104*a* extending between the top surface 102 and the bottom surface 103 and having an length, and a overbite block 105 proximate the first gripping edge. In one embodiment, the top surface 102 and bottom surface 103 are generally planar, however they may alternatively have some curvature.

The gripping member 101 is attachable to a work tool, as will be described below, and may be reversible. For example, the gripping member may have a second gripping edge 104*b*, wherein the second gripping edge 104*b* also has a overbite block 105. Therefore, when the first gripping edge 104*b* becomes worn, the gripping member may be reversed such that edge 104*b* is now used when gripping material. The gripping member 101 may extend the complete available width of an associated grapple.

Figure 3:
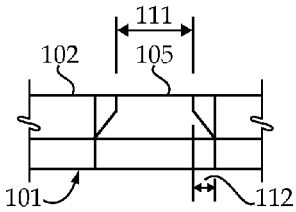
FIG. 3 illustrates a side view of a overbite block of the gripping member.
Figure 4:
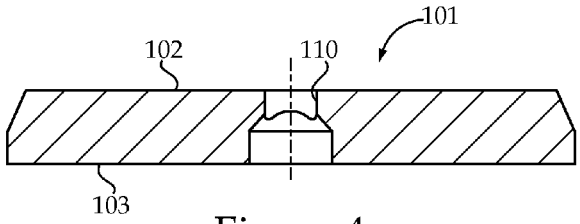
FIGS. 4 and 5 are cross-sectional views of a gripping member as hereinafter described through lines A-A and B-B of FIG. 2.
Figure 5:
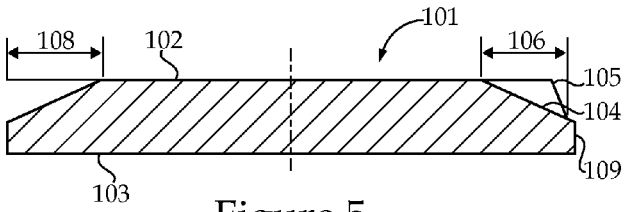

The shaping and positioning of the overbite block 105 may be such that it does not interfere with normal operation of the gripping member 101 when attached to a grapple. For instance, overbite block 105 may have a depth 106 that is less than the gripping edge width 108 of the gripping edge 104 such that the overbite block 105 is slighting inboard from the leading edge 109 of the gripping edge 104 as best shown in FIG. 5. FIG. 3 shows that overbite block 105 may have a top width 111 that tapers outward via a taper width 112 to a wider base where it merges with the angled top of gripping edge 104.

The overbite block 105 may be located anywhere on the gripping member. However, in one embodiment it is located proximate a middle portion of the length of the gripping edge. In one embodiment, the overbite block may be located proximate the middle portion of the gripping edge length, but offcenter of the length. The overbite block 105 may be considered an extension of the top surface, the gripping edge, or the bottom surface. In one embodiment, the overbite block 105 may be located proximate one of the side surfaces of the gripping member. The function of the overbite block is to urge the edge surface into contact with another surface associated with the work tool (e.g., a second edge surface of a second member). In one embodiment, the overbite block 105 is a nub or a bump. However, other configurations of a overbite block may be used. Thus overbite block 105 may have been machined on to be integral with gripping member 101, may be a separately machined uniform block of material welded onto gripping member 101, or may merely be a separate piece attached to gripping member with a suitable fastener(s). Therefore, the overbite block is located and configured in a manner such that it enables the edge surface to contact a second edge surface. In one embodiment, as will be discussed later, the overbite block enables the gripping edge to contact or engage a contact surface (such as a second gripping edge) on the work tool to achieve a desired position. The desired position may be a closed position where the edge surface is in contact, or substantially in contact with a second contact surface, such as a second edge surface. For example, desired gripping position is a position where an overbite does not exist, and a gap in between the gripping surface and contact surface does not exists. Alternatively, or in addition, the desired gripping position is the position where two gripping surfaces of respective gripping members are in contact with each other. Therefore, in one embodiment, as will be explained, the overbite block on one edge surface is configured to interact with a second gripping edge surface such that as either the first or second edge surfaces wear, the first gripping edge continues to substantially engage the second gripping edge surface.

In one embodiment, the overbite block is a nub, or bulge. However, the guide may take other structural forms attached to (or formed in) the gripping member to enable a gripping edge to achieve the desired gripping position.

The gripping members may be attached to the work tool in a known manner, such as bolts or screws passing through holes 110 in the gripping member and into or through the respective shells of the work tool.

The gripping edge may be a sloped edge, a beveled edge and/or a cutting edge (e.g, a bladed edge).

The gripping member may be attachable to a work tool such as a grapple or some other form of work tool used to grip material, tear down structures, sort, pick, place, load or cut materials. One example of such a work tool is a grapple. The grapple could be attached to an excavator or a back hoe.

Figure 6:
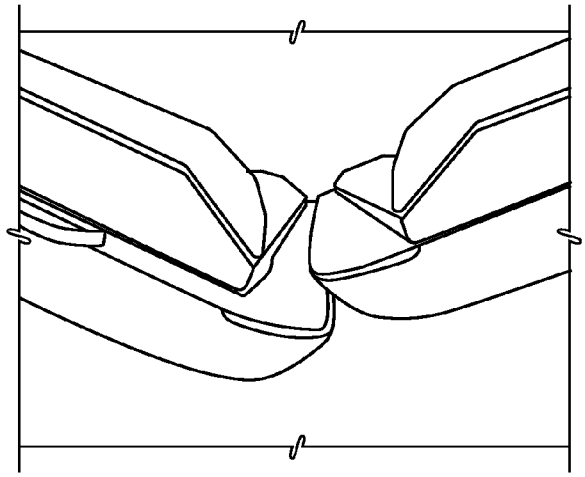
Figure 6 (Prior Art)
FIG. 6 illustrates an overbite, a gap and engaged contact surfaces between gripping edges in prior art gripping members installed on a grapple.
Figure 7:
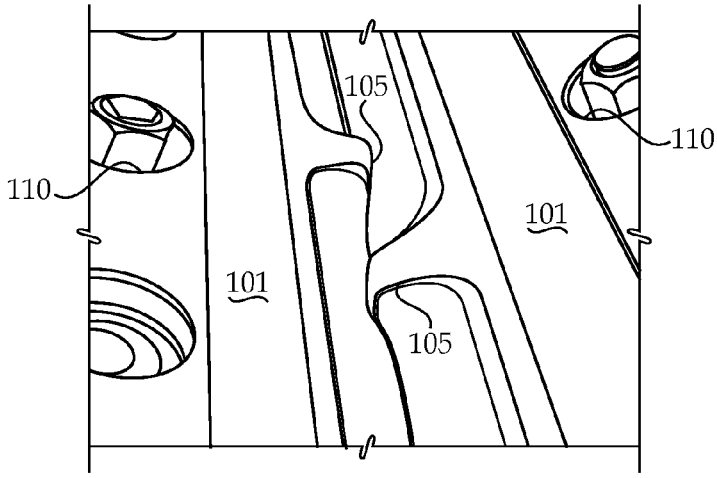
FIGS. 7-8 illustrates a gripping members according to the present disclosure installed on a grapple to prevent overbite of the type shown in FIG. 6.
Figure 8:
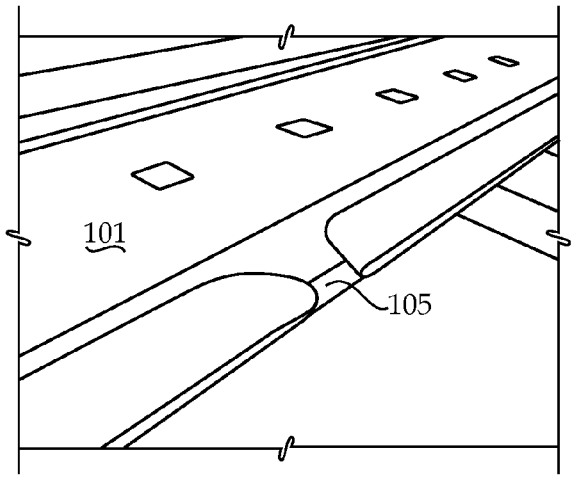

The work tool may be configured to use two of these gripping members, as shown in FIG. 7. FIG. 7 shows that with the inclusion of overbite block 105, the overbite situation illustrated in FIG. 6 is prevented. In other words, which ever side of the grapple tends to overbite the other, the associated cutting edge 104 will contact the overbite block 105 on the opposing gripping member to prevent the overbite situation as shown in FIG. 6, and maintain a better ability of the machine to function as normal even when these circumstances arise. FIG. 8 merely shows a perspective view of one of the gripping members 101 shown from FIG. 7.

Figure 9:
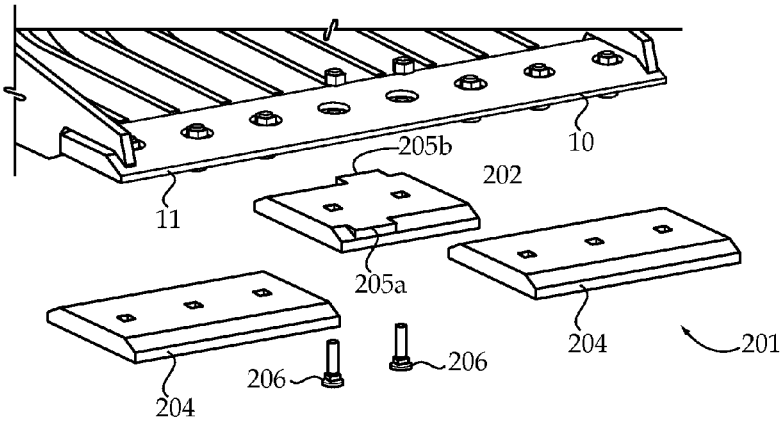
FIG. 9 shows an exploded perspective view of a second embodiment of a gripping member with grapple according to the present disclosure.

Referring now to FIG. 9, a second embodiment of a gripping member 201 according to the present disclosure has three separate pieces in order to extend the complete width of grapple 10. In other words, three separate gripping member components 201, 202 and 204 are necessary to extend the grapple width. Thus, the length of any one of the gripping member components 201, 202 and 204 is less than the grapple width. This alternative structure may allow for different ones of the components 204 and 202 to be replaced or reversed depending up on different wear patterns rather than the complete gripping member 101 as shown in the earlier figures. In this embodiment, the flanking components 204 may be identical to further reduce part count. The center piece 202 may include off center overbite blocks 205*a* and 205*b* on opposite sides thereof. As stated earlier, overbite blocks 205*a* may be attached with fasteners, welded on, or integrally formed as a portion of component 202 when the same is machined from raw stock. The individual components 204 and 202 may be attached to grapple 10 using fasteners 206 in a conventional manner.

Figure 10:
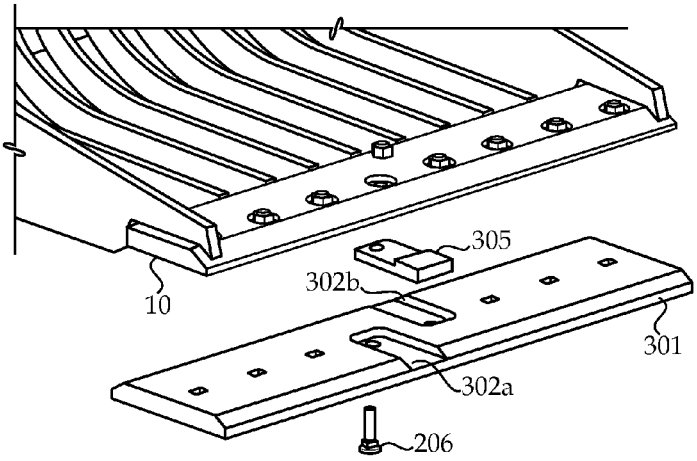
FIG. 10 shows an exploded perspective view of a third embodiment.

Referring now to FIG. 10, still another embodiment of the present disclosure includes a full width gripping member 301 that includes a bolt on overbite block 305 via a conventional fastener 206 when the gripping member 301 is attached to grapple 10. The gripping member 301 differs from a conventional gripping member in that it includes a cavity 302*a* and/or 302*b* for receiving the overbite block 305 with an associated shape and size. The overbite block 305 becomes attached to the gripping member 301 when the gripping member is attached to the grapple 10, but the two are otherwise unconnected when separated from the grapple 10.

Figure 11:
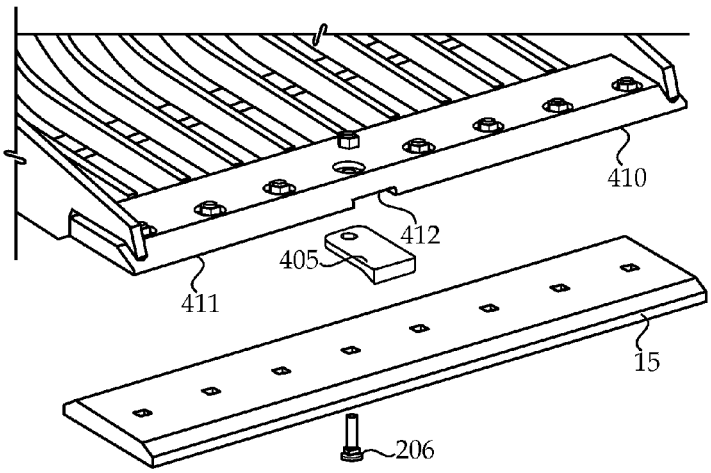
FIG. 11 shows an exploded perspective view of a fourth embodiment.

Referring now to FIG. 11, still another embodiment of the present disclosure shows the grapple 410 that is modified to include a cavity 412 for receiving an appropriately sized and shaped overbite prevention block 405 that becomes attached to grapple 410 when a conventional bolt on cutting edge 15 is attached thereto with conventional fasteners 206. Thus, in both of the embodiments shown in FIGS. 10 and 11, the overbite block 305 or 405 is formed from a uniform block of material with an appropriate size and shape to be received in the associated cavity of either the gripping member 301 or the grapple base bar 411, respectively. In both cases, the overbite block includes a gripping member contact surface and a grapple base bar contact surface and includes a fastener bore extending through those surfaces. In the case of overbite block 405, it includes a gripping member contact surface that is contoured to match the top surface of a conventional bolt on cutting edge 15. In both cases, the overbite block 305 and the overbite block 405 have a side surface shaped to match the respective cavity defined by either the gripping member 301 or grapple base bar 412.

Those skilled in the art will appreciate that the various features shown in FIGS. 1-11 according to the different embodiments may be combined in different ways and still remain within the intended scope of the present disclosure. The design of FIG. 4 has an advantage in that only the base bar 411 of grapple 410 needs to be modified in order to accommodate a overbite block 405 associated with the present disclosure, and may be used with conventionally available bolt on cutting edges 15 of the type well known in the art. As each overbite prevention block would wear out, a replacement could easily be installed by detaching the conventional bolt on cutting edge 15 and installing a replacement overbite block 405.

Industrial Applicability

In one embodiment, a grapple may have two gripping members attached to respective shells of the grapple. With new gripping members, the gripping surfaces will close to the desired position, when the shells are closed. However, as the gripping members wear, the overbite blocks enable the gripping surfaces to continue to close to the desired position (that is, the guide enables or urges the an edge surface to substantially be in contact with a second contact surface associated with the work tool, such as a second edge surface. For example, if the surfaces have worn to the point that traditional worn gripping surfaces would form an overbite, then using one embodiment of the present invention, as the shells close, the gripping surface that would otherwise close on the inside of the second gripping surface, would make contact with the overbite block associated with the second gripping surface. As closing force is continued to be applied to the shells (for example, via a hydraulic force applied to the shells of the grapple), the inner gripping surface will be urged, or guided into contact with the second gripping surface, through engagement with the overbite block of the second gripping surface.

In one embodiment, by having overbite blocks on both gripping surfaces as shown in FIG. 7, it does not matter how the overbite forms (or which gripping surface is going on the outside or inside of the other), an overbite block is contacted and enables the gripping surfaces to reach the desired gripping position.

In one embodiment, the overbite blocks are located on respective gripping surfaces such that they are not located directly across from each other.

As a gripping member wears over time, they may be reversed. Over time, they may be completely replaced with new gripping members.

In one embodiment, having the overbite block proximate the edge surface, enables the overbite block to wear in approximate proportion with the edge surface.

Those skilled in the art will appreciate that the overbite block of the present disclosure can come in several different forms either as part of a bolt on cutting edge gripping member or a separate component that has an identity of its own prior to installation to a grapple 10. Those skilled in the art also appreciate that the different aspects of the four different embodiments could appear in different combinations into still other embodiments without departing from the present disclosure. The design of FIG. 11 may find favor in some instances since it requires no modification to the conventional bolt on cutting edges 15 currently being used with grapples on current machines. Instead, the only modification may be to the base bar 411 of the grapple 410 and a new part introduced, namely an overbite block 405. Thus, current machines could be modified by replacing the base bar 411 of their grapple 410 with a modified bar as shown in FIG. 11 and then include, from time to time, replacement overbite blocks 405 to prevent the overbite situation illustrated in FIG. 6.

From the foregoing it will be appreciated that, although specific embodiments of the invention have been described herein for purposes of illustration, various modifications may be made without deviating from the spirit or scope of the invention. Other embodiments of the invention will be apparent to those skilled in the art from consideration of the specification and figures and practice of the invention disclosed herein. It is intended that the specification and disclosed examples be considered as exemplary only, with a true scope and spirit of the invention being indicated by the following claims and their equivalents. Accordingly, the invention is not limited except as by the appended claims.

What is claimed is:

1. A gripping member attachable to a grapple that includes two gripping members that are attached to the grapple and grip a material when the two gripping members are brought together, the gripping member comprising:

a top surface;

a bottom surface;

a first gripping edge extending between the top surface and the bottom surface and having a length;

an overbite block located proximate to the first gripping edge; and wherein the overbite block is located and configured to contact an opposing gripping edge of a second gripping member of the grapple responsive to wear of one of the first gripping edge and the opposing gripping edge to prevent an overbite situation.

2. The gripping member of claim 1, wherein said overbite block is located proximate a middle portion of said first gripping edge.

3. The gripping member of claim 1, wherein said overbite block is located off center of a middle of said first gripping edge.

4. The gripping member of claim 1 wherein said gripping member includes a second gripping edge, said second gripping edge having a guide located in a middle portion of said second gripping edge, and further wherein, said gripping member is reversibly attachable when the first gripping edge becomes worn.

5. The gripping member of claim 1, wherein said first gripping edge is a cutting edge.

6. The gripping member of claim 1, wherein said first gripping edge is a beveled edge.

7. The gripping member of claim 1, wherein said guide is a nub located proximate a midpoint of the gripping edge length.

8. The gripping member of claim 1, wherein the length of said first gripping edge is less than a grapple width.

9. A grapple comprising:

a first grapple base bar movable toward a second grapple base bar;

a first gripping member attached to the first grapple base bar, said first gripping member having a top surface, a bottom surface, a first gripping edge, said first gripping edge having a length, and a first overbite block located proximate the first gripping edge;

a second gripping member attached to the second grapple base bar, said first gripping member having a top surface, a bottom surface, a second gripping edge, said second gripping edge having a length, and a second overbite block located proximate the second gripping edge;

wherein the first overbite block is located and configured to contact the second gripping edge responsive to wear of at least one of the first gripping edge and the second gripping edge to prevent an overbite situation;

wherein the second overbite block is located and configured to contact the first gripping edge responsive to wear of at least one of the first gripping edge and the second gripping edge to prevent the overbite situation.

10. The grapple of claim 9, wherein said overbite block of each respective first and second gripping member is located proximate a middle portion of the respective first and second gripping edges.

11. The grapple of claim 9, wherein each of the first grapple base bar and second grapple base bar has a wear width;

each of the first and second gripping member has a width that is less than the wear width.

12. The grapple of claim 9, wherein each of the first and second gripping members are separate components that only become attached to one another when fastened to a grapple base bar with at least one fastener.

13. The grapple of claim 9, wherein the first overbite block is a second component received in a cavity defined by one of the first gripping member and the first grapple base bar of the grapple.

14. The grapple of claim 13, wherein the first overbite block is received in a cavity defined by the first grapple base bar of the grapple.

15. An overbite block for attachment to a grapple to prevent an overbite configuration of a first gripping member with respect to a second gripping member, the overbite block comprising:

a uniform block of material having a single fastener bore therethrough that is located remote from a wear face;

the overbite block having a rectangular shape and being sized to be received in, and match a shape of, a rectangular cavity defined by a gripping member of a grapple;

the overbite block including a gripping member contact surface and a grapple base bar contact surface;

a centerline of the uniform block intersecting the single fastener bore and the wear face along a longer dimension of the rectangular shape; and wherein the overbite block is sized and shaped to prevent an overbite configuration when the grapple is closed.

16. An overbite block for attachment to a grapple to prevent an overbite configuration of a first gripping member with respect to a second gripping member, the overbite block comprising:

a uniform block of material having a single fastener bore therethrough that is located remote from a wear face;

the overbite block having a shape and size to be received in a cavity defined by a one of a gripping member and a base bar of a grapple;

the overbite block including a gripping member contact surface and a grapple base bar contact surface; and wherein the gripping member contact surface is contoured to match a top surface of a conventional bolt on cutting edge.

17. The overbite block of claim 16, wherein the overbite block includes a side surface shaped to match a cavity defined by a base bar of a grapple.

18. The overbite block of claim 17, wherein the fastener bore is a single wherein the at least one fastener bore is a single fastener bore extending through both of the gripping member contact surface and the grapple base bar contact surface.

* * * * *